US009162785B2

(12) United States Patent
Wieck et al.

(10) Patent No.: US 9,162,785 B2
(45) Date of Patent: Oct. 20, 2015

(54) METHOD AND NOZZLE FOR SUPPRESSING THE GENERATION OF IRON-CONTAINING VAPOR

(75) Inventors: Dietmar Wieck, Tonisvorst (DE); Christian Windhovel, Garches (FR)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 86 days.

(21) Appl. No.: 13/980,226

(22) PCT Filed: Jan. 18, 2012

(86) PCT No.: PCT/EP2012/050734

§ 371 (c)(1), (2), (4) Date: Jul. 17, 2013

(87) PCT Pub. No.: WO2012/098169

PCT Pub. Date: Jul. 26, 2012

(65) Prior Publication Data

US 2013/0291489 A1 Nov. 7, 2013

(30) Foreign Application Priority Data

Jan. 19, 2011 (DE) ..... 10 2011 008 894

(51) Int. Cl.

| | |
|---|---|
| ***C21C 5/38*** | (2006.01) |
| ***B65B 29/00*** | (2006.01) |
| ***C21C 7/00*** | (2006.01) |
| *C21B 7/14* | (2006.01) |

(52) U.S. Cl.

CPC ..... *B65B 29/00* (2013.01); *C21C 7/0043* (2013.01); *C21C 7/0068* (2013.01); *C21B 7/14* (2013.01)

(58) Field of Classification Search

CPC ..... B65B 29/00; B22D 11/106
USPC ..... 75/709
See application file for complete search history.

(56) References Cited

U.S. PATENT DOCUMENTS 4,141,507 A * 2/1979 Rump ..... 239/590.5
4,666,511 A 5/1987 Naud (Continued)

FOREIGN PATENT DOCUMENTS

| | | | |
|---|---|---|---|
| DE | 10 2005 005638 | | 2/2006 |
| JP | 06257938 A | * | 9/1994 |
| WO | WO 98 21373 | | 5/1998 |

OTHER PUBLICATIONS

International Search Report for PCT/EP2012/050734, mailed May 30, 2012.

*Primary Examiner* — Scott Kastler
(74) *Attorney, Agent, or Firm* — Christopher J. Cronin

(57) ABSTRACT

A method, an installation and a nozzle (1) for suppressing the generation of iron-containing vapor during filling or emptying of a container (2) for an iron-containing metal melt with the aid of $CO_2$ snow, a $CO_2$ snow jet (22) being applied by means of the nozzle (1) dispersing in a substantially planar manner onto a surface of an iron-containing stream (23) which is poured into or out of the container (2). The invention consequently at least partially solves the technical problems outlined in connection with the prior art. In particular, a device is proposed which allows cost-effective and space-saving suppression of the generation of iron-containing vapor during the filling or emptying of a container 2 with the aid of a reduced $CO_2$ snow quantity.

17 Claims, 2 Drawing Sheets

(56) References Cited

U.S. PATENT DOCUMENTS 4,781,122 A 11/1988 Foulard et al.
4,915,362 A 4/1990 Borasci et al.
5,683,652 A 11/1997 Fünders et al.

* cited by examiner

METHOD AND NOZZLE FOR SUPPRESSING THE GENERATION OF IRON-CONTAINING VAPOR

CROSS-REFERENCE TO RELATED APPLICATIONS

This application is a §371 of International PCT Application PCT/EP2012/050734, filed Jan. 18, 2012, which claims §119 (a) foreign priority to German patent application 10 2011 008 894.6, filed Jan. 19, 2011.

BACKGROUND

1. Field of the Invention

The invention relates to a method for suppressing the generation of iron-containing vapor during the filling or emptying of a container for an iron-containing metal melt with the aid of $CO_2$ snow.

2. Related Art

In iron-containing melts, such as, for example for pig iron, gray cast iron or steel, what is known as "brown smoke" is generated on the surface of the melt in contact with the atmosphere. This brown smoke is for the larger part composed of iron oxide. The iron in the melt reacts with (atmospheric) oxygen and is released from the surface of the iron melt at molecular level in the form of vapor. Since this very fine dust can easily be breathed in and both clogs the lungs and is partially absorbed into the bloodstream, attempts were made even at an early stage to evacuate the brown smoke, for example by means of suction extraction equipment.

For many processes which require a large amount of space or even take place outdoors, the use of suction extraction equipment cannot be implemented expediently or even technically at least with regard to the costs and size of the equipment.

For such purposes, it has proved useful to displace the atmospheric oxygen in the area of the surface of the melt by means of inert gases, such as, for example, nitrogen ($N_2$) and/or carbon dioxide ($CO_2$) as is known, for example, from DE 39 30 04 415 (US equivalent is U.S. Pat. No. 5,683,652).

In converters, pig iron and iron-containing scrap are converted into steel melt by the top-blowing of oxygen so that excess carbon is oxidized out. During operation, the converter is a container which is open at the top, yet is sufficiently closed off by means of a suction extraction hood, so that a gas volume corresponding to the volume of oxygen supplied is completely evacuated through the suction extraction hood. Simultaneously the iron oxide vapor, which also partially arises, is very effectively extracted by suction because of the relatively small and clearly delimited suction extraction volume. When the converter is being filled and emptied, however, this vessel is pivoted forward beneath the suction extraction hood, so that, at the very least, sufficient suction extraction can no longer be ensured.

As a result of the increasingly restrictive stipulations, such as for example in Germany: the statutory regulations related to flue gas and dust of the Federal Anti-pollution Law, it is necessary for the brown smoke which emerges to be evacuated.

Generally, in the steel industry, large and costly plants are employed which are used for long periods of time so as to be profitable. In the past, such plants have become ever larger, for example in such a way as to increase energy and cost efficiency, although the factory building size was usually, if possible, not changed for reasons of costs and available space. Suction extraction equipment for the entire factory building is often ruled out, not only for reasons of high installation costs, but also because of the restricted space available.

SUMMARY OF THE INVENTION

Starting therefrom, the present invention aims to overcome at least partially the known disadvantages of the prior art. In particular, a method and a device are provided, by means of which the suppression of iron-containing vapor can be obtained in a space-saving and cost-effective way in terms of both installation and operating costs.

This aim is achieved by means of a method and installation for suppressing the generation of iron-containing vapor and by a nozzle for producing a substantially planar $CO_2$ snow jet as defined in the independent claims. Advantageous further embodiments are the subject matter of the dependent claims.

The method of this invention for suppressing the generation of iron-containing vapor during the filling or emptying of a container for an iron-containing metal melt by means of $CO_2$ snow is proposed, a $CO_2$ snow jet being applied by means of a nozzle dispersing $CO_2$ snow in substantially planar manner onto a surface of an iron-containing stream which is poured into a container or from a container.

It was presumed, in the past, that iron-containing vapor is generated, mainly, as a result of the displacement of atmospheric oxygen. Furthermore, it was presumed that cooling of the surface of the iron-containing stream effectively reduces the reaction rate. However, in connection with this invention, it was found that these effects are, at most, marginal phenomena but are not the reason why the generation of iron-containing vapor is suppressed. Instead, by applying $CO_2$ snow onto the surface of an iron-containing stream, the occurrence of thermal drag can be prevented. Since the iron-containing melt is at very high temperature, thermal drag occurs due to heated air rising, similarly to the chimney effect. As a result of this upward movement of the heated air, the iron oxide particles or iron oxide molecules which have arisen are entrained. This effect causes the partial pressure of the vaporous iron oxide near the surface always to be extremely low. Due to the ever recurring stoichiometric imbalance near the surface, the formation of new iron oxide particles or iron oxide molecules is constantly reinitiated. It is therefore useful to prevent thermal drag and thereby to keep the partial pressure of the iron oxide at the surface of the iron-containing melt high or to create a stoichiometric equilibrium near the surface.

The $CO_2$ snow jet is preferably applied onto the surface such that thermal drag is reduced.

$CO_2$ snow is particularly appropriate for this purpose. On the one hand, the surface is effectively cooled by the dry ice constituents or as a result of the sublimation of the dry ice and, the quantity of oxygen near the surface of the iron-containing melt is furthermore greatly reduced. The remaining thermal drag is substantially prevented by the solid constituents in the $CO_2$ snow (dry ice) due to the relatively high specific mass in conjunction with the good bond between the "snow crystals". On account of this effect, it is possible to apply only very small quantities of $CO_2$ snow onto the surface of the iron-containing stream. The operating costs of $CO_2$ snow equipment are consequently markedly reduced, as compared with currently used equipments. The $CO_2$ snow subsequently evaporates in the form of gas and therefore has scarcely any to no (harmful) effect on the composition of the iron-containing melt.

To produce such an economical $CO_2$ snow jet, a nozzle dispersing in a substantially planar manner is deployed. What is mainly achieved by this nozzle dispersing in a substantially planar manner is that a thin (coherent) $CO_2$ snow layer is applied onto the surface of the iron-containing stream. The term "substantially planar" primarily refers to the fact that a $CO_2$ snow jet is produced with a width larger than its height (or thickness), in particular larger by a multiple than its height. The iron-containing stream poured into or from the container for an iron-containing metal melt has a surface which is in contact with the atmosphere over the entire circumferential area or the differential circumference per unit time of the pouring stream. The $CO_2$ snow can be applied onto this entire surface of the iron-containing stream. Since it was found that the displacement of oxygen or the reduction of the surface temperature is not critical for the suppression of iron-containing vapor, but rather the prevention of thermal drag, the application of $CO_2$ snow can be limited to those surface areas which present at least no downwardly directed normal. No appreciable thermal drag is generated at the surface areas with a downwardly directed normal, and therefore the partial pressure of iron oxide particles or iron oxide molecules near these surface areas of the iron-containing stream is so high that only negligible generation of smoke can be observed. This means that lateral and lower regions of the iron-containing stream can be left open to the atmosphere, without this leading to excessive formation of iron oxide particles or iron oxide molecules. A further reduction in the consumption of $CO_2$ snow is thereby achieved, without increased generation of iron-containing vapor.

Such a container for an iron-containing metal melt may be a converter, a blast furnace, a transport vessel for pig iron or the like. The iron-containing metals are preferably pig iron or steel. However, the iron-containing metals are characterized, above all, in that they present an iron concentration such that a sufficient iron oxide partial pressure occurs at the surface of the iron-containing metal melt in contact with the atmosphere, so that smoke is generated. Especially preferably, the method of the invention can be used during the filling or emptying of converters with iron-containing melts, such as, for example, pig iron or steel, since iron-containing vapor occurs to a great extent in these processes.

In a further advantageous embodiment of the method according to the invention, the nozzle dispersing in a substantially planar manner is positioned at a distance of at least 1 m, in particular of at least 3 m from the container, preferably with the aid of guide means.

Iron-containing melts usually have low viscosity. This leads to extremely high flow velocity because of the high specific mass. The poured iron-containing stream therefore not only emits great heat, but also, since melt splashes cannot be completely prevented, creates a hazard to persons in the vicinity of the iron-containing stream. Also, excessive application of a refrigerant may lead to abrupt evaporations of the refrigerant and consequently also to increased formation of splashes. To enhance safety, therefore, the nozzle may be indirectly put into position with the aid of guide means. At a safety distance of at least 1 m, preferably of at least 3 m, the nozzle can be controlled mechanically by a guide arm. The nozzle can likewise be brought in from above the metal stream and be put into position by motorized means and remote control. It is advantageous for the nozzle always to be directly visible to the operator and if it can be at any time taken out of the danger zone from a safe distance so as to protect it from damage. It is also furthermore advantageous, for the nozzle to cover such a range of movement in the danger zone of the iron-containing stream that it can be used as an extinguisher in the event of unforeseen incidents. If a distance of only 1 m is maintained, the person (operator) who is positioning or controlling the nozzle should be safely protected by a protective screen.

In a further advantageous embodiment of the method according to the invention, the temperature of the surface of the iron-containing stream is detected and a quantity of $CO_2$ snow to be supplied is adjusted to the detected temperature.

In order to keep wear low, not to disturb the flow of the iron-containing stream and to avoid melt splashes, it is advantageous, in particular, to use indirect temperature measurement transducers. These include, for example, a thermal imaging camera which converts the thermal radiation into visible colors or automatically usable measurement data and makes it possible for the surface temperature to be determined. The temperature may also be detected at points in the vicinity of the stream. It is also possible to introduce a high-temperature resistant sensor needle into the stream. The adjustment of the quantity of $CO_2$ snow to be supplied may, on the one hand, be based on the experience of the operator and/or, on the other hand, be automatically regulated directly or indirectly on the basis of stored characteristic values.

In a further advantageous embodiment of the method of the invention, the iron-containing stream has a width and the $CO_2$ snow jet covers said width completely.

The width of the $CO_2$ snow jet can hereby be determined by both (a) the distance between the iron-containing stream and the nozzle dispersing in a substantially planar manner and (b) the fan shape of said nozzle. The width of the $CO_2$ snow jet may also be constant over a distance from the iron-containing pouring stream. It is particularly advantageous for the $CO_2$ snow jet to cover the iron-containing stream over its entire width with $CO_2$ snow, without the nozzle having to be moved for this purpose after initial positioning. This is advantageous in particular when the iron-containing stream requires, in normal operation, a $CO_2$ snow quantity which is constant over the entire width of the surface.

In a further advantageous version of the method of the invention, the $CO_2$ snow jet supplies less than 500 kilograms $CO_2$ per minute, in particular of less than 200 kilograms $CO_2$ per minute.

In order to keep the operating costs of the $CO_2$ snow equipment low, the smallest possible quantity of $CO_2$ is to be used for the purpose of performing the method. This is also necessary regarding $CO_2$ certificates, of which the future financial burden for the steel industry can even now not be ignored. Volumes of industrial gas are commonly designated according to DIN (German Industrial Standard) 1945. According to this norm, a quantity of industrial gas is defined at a pressure of 1 bar, a temperature of 20° C. and 0% relative humidity. A further common designation corresponds to DIN 1343, according to which the quantity of industrial gas is defined at a pressure of 1013.25 hPa (Hecto Pascal) and a temperature of 273.15 K (Kelvin). The quantity of $CO_2$ used depends, in particular, on the temperature of the iron-containing stream and further, only linearly, on the volume of the iron-containing stream, since only the width of the surface is relevant for the method. Consequently, in contrast to when using only suction extraction equipment, the pouring volume of the metal melt can be suitably maximized. The consumption of $CO_2$ is also proportional to the duration of the pouring operation.

The invention also relates to a nozzle for producing a substantially planar $CO_2$ snow jet for suppressing the generation of iron-containing vapor during the filling or emptying of a container, the nozzle having an inlet and an outlet spaced at a distance along an outlet axis, the outlet axis being oriented perpendicularly to a vertical axis and to a transverse axis, the nozzle tapering along the vertical axis toward the outlet to an outlet height and widening along the transverse axis toward the outlet to an outlet width.

With regard to this nozzle, which is adapted for the method described above, the term "substantially planar" likewise means that the thickness (or height) of the $CO_2$ snow jet is markedly smaller than the width. In particular, the ratio of thickness to width lies in a range of 0.01 to 0.8, preferably of 0.05 to 0.5, especially preferably of 0.08 to 0.1. This means in particular that the produced $CO_2$ snow jet covers at least part of the surface of the stream over a large area, and this either dependently on or independently of the distance from the nozzle to the surface of the iron-containing stream. This means more specifically that a $CO_2$ snow jet is produced which after leaving the nozzle, either fans out further or has a constant width. In the former case, the covering of the surface of the iron-containing stream can be determined and varied by varying the distance of the nozzle to the stream. In the latter case, the covering remains (virtually) the same independently of the distance.

It is especially preferred to cover that part of the surface which presents a surface normal having a vector component which is directed opposite to gravity and which surface is therefore, for example, directed essentially horizontally. This part of the surface is prevailing for the thermal drag; because only the air there is, on account of its position, free to rise when heated. Due to inertia, the (heated) air located under the iron-containing stream, in particular, remains underneath the iron-containing stream to a sufficient extent so as to generate no thermal drag there.

After leaving the nozzle, the $CO_2$ snow jet is composed mainly of dry ice and cold gaseous $CO_2$, with a mixture ratio of about 1 to 1, and only negligible amounts of liquid $CO_2$. The designation "snow" derives from the fact that the dry ice is present as many small crystals spaced apart from one another. It consequently acquires its whitish color as a result of light refraction in exactly the same way as water snow. In contrast to a block-like solid of low porosity, the large surface area resulting from this snow structure promotes the change of the state of aggregation from solid to gaseous phase (sublimation) without transition via the liquid phase, so that sublimation enthalpy can also be used for cooling. A good cooling capacity is thereby achieved. The snow form of the dry ice furthermore forms a coherent mass which effectively shields the surface of the iron-containing stream from the environment, more specifically the atmosphere. Moreover, this snow mass can only be penetrated with difficulty by rising gases and can even less so be lifted by these gases. Consequently, in contrast to the use of gaseous or liquid inert gases, a snow layer, just thick enough for the necessary cohesion is sufficient.

The "filling or emptying" of a container refers more specifically to the state in which the suction extraction of the container is no longer capable of suction-extracting the iron-containing vapor to a sufficient extent as a result of the pivoting movement of the container. It also refers, in particular, to the state in which the iron-containing melt in the form of a stream is open to the environment, more particularly the atmosphere.

Liquid $CO_2$ is introduced at the inlet of the nozzle. A space is to be created which is conducive to a sudden expansion of the liquid $CO_2$ and therefore to the occurrence of dry ice. The outlet of the nozzle should be configured such that a substantially flat and wide $CO_2$ snow jet emerges from the outlet with sufficient velocity, so that the substantially planar $CO_2$ snow jet impinges in suitable form onto the metal stream surface at a distance from the outlet of the nozzle. The configuration between inlet and outlet is to be such that the $CO_2$ snow generated at the inlet is transported to the outlet preferably at a constant velocity and with a constant composition. The distance between the inlet and outlet along the main direction of movement of the $CO_2$ snow (outlet axis) is to be determined in function of the fan width and velocity. The vertical axis and transverse axis are to be understood, in particular, according to a relative system of coordinates which is fixed in relation to the nozzle. The tapering and widening toward the outlet can, in particular, be chosen so that the section area is constant along the outlet axis as far as the inlet and corresponds to the area formed at the outlet by the outlet height and outlet width. Thereby the pressure on the $CO_2$ snow remains on average constant. However, the tapering and widening may also be such that the ultimate $CO_2$ snow composition and distribution are fixed only in the outlet region or directly in the vicinity of the outlet outside the nozzle.

In a further advantageous embodiment of the nozzle according to the invention, the liquid $CO_2$ may be injected into the nozzle into an inlet region of the nozzle along the vertical axis.

Thereby, because of the geometry of the nozzle as described above, an outstanding decompression of the liquid $CO_2$ is achieved due to the created underpressure of the $CO_2$ flowing towards the outlet. Furthermore, the $CO_2$ is in this way distributed especially uniformly and leads to a uniform substantially planar $CO_2$ snow jet.

In a further advantageous form of the nozzle according to the invention, the outlet width corresponds to the distance between the inlet and outlet. With these spatial proportions, an especially uniform $CO_2$ snow jet is obtained because of good pressure equalization. Furthermore, the snow grain size is set optimally via these proportions, since it is determined by the residence time and agglomeration of the $CO_2$ particles in the triangular snow nozzle. In particular, due to the nozzle geometry, the initially fine $CO_2$ snow particles collide and bond into larger flakes which are then accelerated by the gas stream of the gaseous $CO_2$ and consequently travel further than is the case with previous nozzles.

In a further advantageous form of the nozzle according to the invention, the $CO_2$ intake tapers as far as a region of the inlet of the nozzle.

The $CO_2$ intake is designed as an adapter between the nozzle and the feeding system of the $CO_2$ in liquid or gaseous form, so as to subject the $CO_2$ at the transition to the inlet to increased pressure in order to ensure that it is present in liquid form. Furthermore, this ensures in particular, that a constant $CO_2$ snow jet can be produced even in the event of pressure fluctuations in the supply line. The region of the inlet is, in particular, a region in which such a low pressure prevails as a result of the drag effect of the outflowing $CO_2$ so that a very high rate of dry ice is produced.

The invention likewise comprises an installation comprising a container for an iron-containing metal melt and a nozzle according to the invention, spaced apart from the container, the installation being in particular adapted for carrying out the method of the invention. The installation further comprises nozzle controls for positioning the nozzle and for controlling a $CO_2$ snow quantity, said controls being located outside a pouring zone. The nozzle is mobile or movable and can be brought into the pouring zone, for example by means of a movable controllable arm, whereby said arm may be equipped with a heat-resistant image generator.

The container for an iron-containing metal, for example a converter, is conventionally in the form of a bulb and in the normal working condition is covered by a suction extraction hood. For filling and emptying, the container can be pivoted forward under the suction extraction hood. The pouring zone is defined by the pivoting range of the container and by a flow range of the stream. During operation, this range, which is based on the temperatures and on the splash range of the iron-containing stream, is preferably made visible by floor markings or barriers. The nozzle controls are mounted either near the controls for the pivoting of the container or in some other position from which rapid intervention and a good overview for the operator are ensured. The movable controllable arm may be either a device usually present on cranes or else a mechanical arm or robot arm set up specifically for this purpose. Relevant in this case is that the nozzle is subject to permanent and sufficient control by the operator. The heat-resistant image generator is preferably a thermal imaging camera which enables the operator to determine the required $CO_2$ snow quantity. However, any measuring means detecting the ambient temperature of or extending into the stream may also be used. The latter may also enable direct regulation of the $CO_2$ snow quantity. The image generator is in any case to be arranged so that it captures a sufficient surface area of the iron-containing stream in order to bring about a reliable regulation of the method and thereby, safely, a reduction in the generation of iron-containing vapor. This implies in particular that those parts of the surface of the stream which contribute to the generation of iron-containing vapor are captured by the image generator. Also, the observation may be restricted to those parts of the surface which already make it possible to draw conclusions as to the overall generation of iron-containing vapor.

BRIEF DESCRIPTION OF THE FIGURES

The invention and the technical background are explained in more detail below by means of the figures. The figures show especially preferred exemplary embodiments, although the invention is not restricted to these. The figures are diagrammatic and identical components are denoted by the same reference symbols. In the figures.

DETAILED DESCRIPTION OF THE INVENTION

Figure 1:
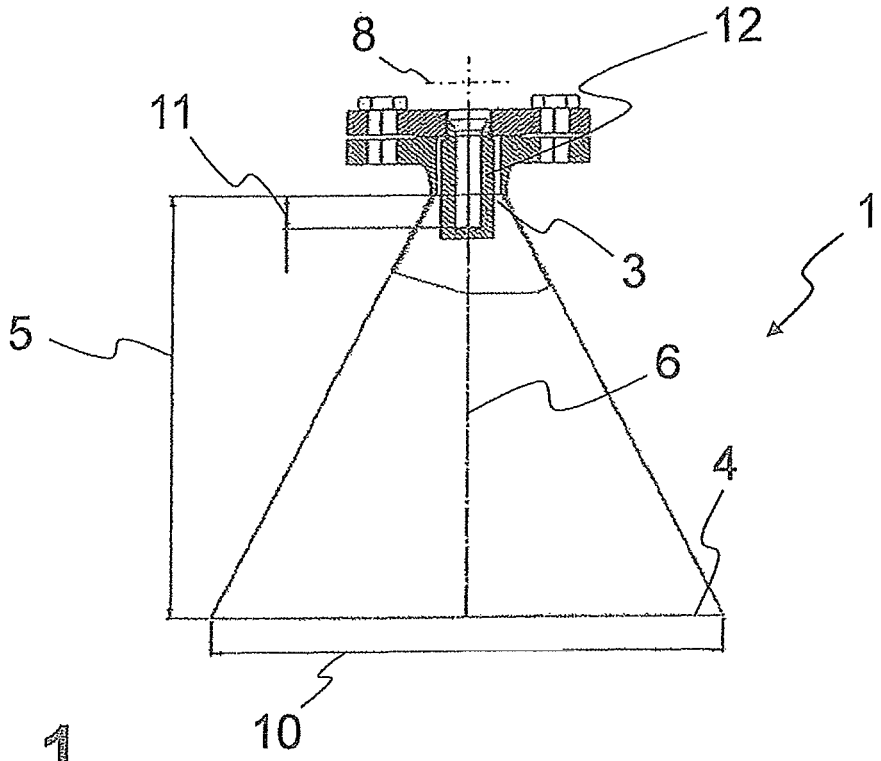
FIG. 1 shows a top view of an exemplary embodiment of a nozzle according to the invention.

A top view of the nozzle 1 according to the invention is shown in FIG. 1. The nozzle 1 has an inlet 3 and an outlet 4 for $CO_2$ (carbon dioxide) which are spaced apart over a distance 5 in the direction of an outlet axis 6. During operation, liquid $CO_2$ can be supplied via an inlet area 11 at the inlet 3. Likewise illustrated in FIG. 1 is an intake 12 which tapers toward the inlet area 11. Furthermore, a transverse axis 8 is shown, in the direction of which the nozzle 1 widens from the inlet 3 toward the outlet 4 along the outlet axis 6 as far as an outlet width 10.

Figure 2:
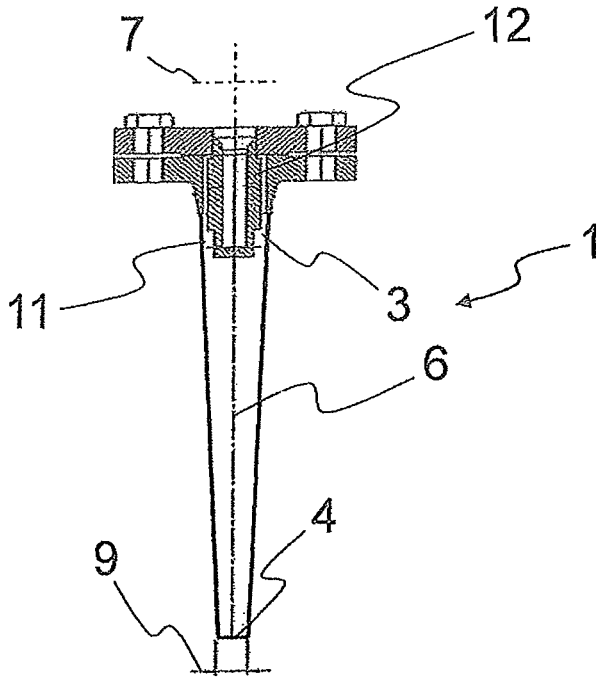
FIG. 2 shows the nozzle according to the invention in cross section.

The nozzle 1 according to the invention is shown in cross section in FIG. 2. The transition from the intake 12 the inlet region 11 at the inlet 3 along a vertical axis 7 can be seen in this view. Furthermore, the taper of the nozzle 1 along the vertical axis 7 in the direction of the outlet 4 from the inlet 3 along the outlet axis 6 as far as an outlet height 9 can be seen.

Figure 3:
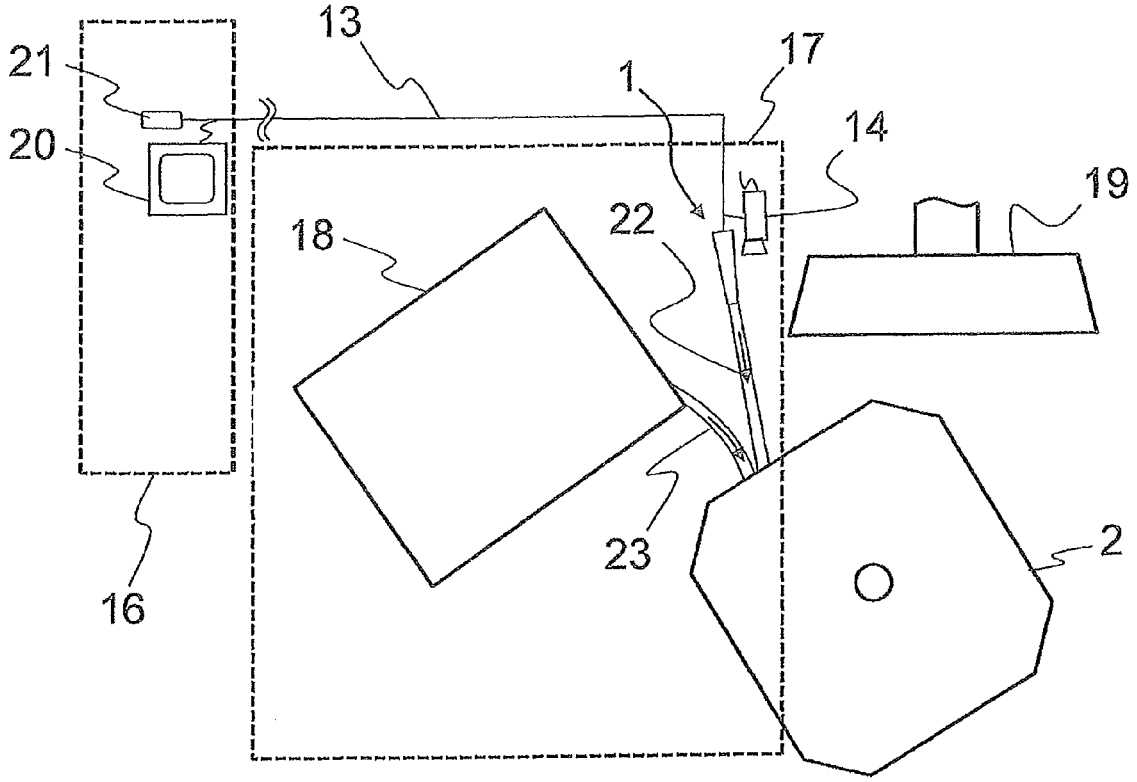
FIG. 3 shows the pivoted container during filling and the nozzle according to the invention during operation.

FIG. 3 shows diagrammatically an embodiment of the method according to the invention. In this case, the nozzle 1 according to the invention is illustrated merely diagrammatically. A container 2 is in a pivoted position beneath a suction extraction hood 19. A ladle 18, by pivoting, pours an iron-containing stream 23 into the container 2. The area of the stream and that of the ladle 18 are included in a pouring area 17, into which an arm 13 equipped with the nozzle 1 and with the image generator 14 extends. The $CO_2$ snow jet 22 *h* emerges from the nozzle 1 and impinges onto the iron-containing stream 23 in the area of the outlet on the container 2. In the other direction, the arm 13 extends into a control area 16 from which control of the nozzle 1 in the pouring area 17 is made possible by nozzle controls, as shown diagrammatically in the form of a joystick 21. Furthermore, located in the control area is a control unit, for example in the form of a visual display unit 20 which shows the values measured by the image generator 14 in the pouring area 17 to the operator in the control area 16. The arm 13 may in this case constitute a purely electronic connection, a mechanical connection or may alternatively be a robot arm.

Figure 4:
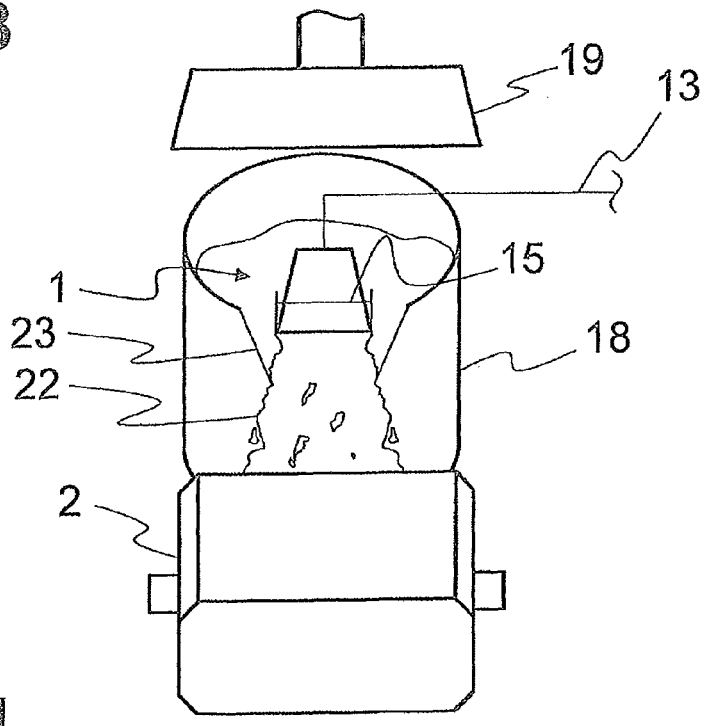
FIG. 4 shows the pivoted container during filling in a front view and a $CO_2$ snow layer on the iron-containing stream.

A front view of the pivoted ladle 18 from the pouring zone 17 (not illustrated), as is illustrated in FIG. 3, can be seen in FIG. 4. In this case, the nozzle 1 on the arm 13 is shown symbolically. What can be seen here is that the nozzle 1 presents a width 15. In this FIG. 4, as in FIG. 3, it can be seen that, because of the pivoting of the container 2, the suction extraction hood 19 is not capable of completely evacuating the iron-containing vapor which is generated in state of the art processes. The $CO_2$ snow jet 22 on the iron-containing stream 23 (not illustrated) is symbolically shown in a fragmented, respectively in an uneven manner, this being attributable to irregularities in the iron-containing metal stream with regard to temperature and flow velocity. It also cannot be seen in FIG. 4 whether a sufficient $CO_2$ snow layer is applied to the iron-containing stream 23 in order to form a protective layer on the surface, not illustrated, of the iron melt in the container 2. Both are possible. Furthermore, a procedure similar to the filling operation illustrated is adopted during the emptying of the container 2.

The invention consequently at least partially solves the technical problems outlined in connection with the prior art. In particular, a device is proposed which allows cost-effective and space-saving suppression of the generation of iron-containing vapor during the filling or emptying of a container 2 with the aid of a reduced $CO_2$ snow quantity.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a non-exclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising". "Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

LIST OF REFERENCE SYMBOLS

1 Nozzle
2 Container
3 Inlet
4 Outlet
5 Spacing
6 Outlet axis
7 Vertical axis
8 Transverse axis
9 Outlet height
10 Outlet width
11 Inlet area
12 Intake
13 Arm
14 Image generator
15 Width
16 Control region
17 Pouring area
18 Ladle
19 Suction extraction hood
20 Video display unit
21 Joystick
22 $CO_2$ snow jet
23 Iron-containing pouring stream

What is claimed is:

1. A method for suppressing the generation of iron-containing vapor during filling or emptying of a container for an iron-containing metal melt with the aid of $CO_2$ snow, characterized in that a $CO_2$ snow jet is applied by means of a nozzle dispersing the $CO_2$ jet in a substantially planar manner onto a surface of an iron-containing stream which is poured into or out of the container, wherein:

the nozzle has an outlet axis, a vertical axis, a transverse axis, an inlet and an outlet;

the inlet and outlet are are spaced apart by a distance along the outlet axis;

the outlet axis is perpendicular to the vertical axis and the transverse axis; and the nozzle tapers along the vertical axis toward the outlet to an outlet height and widens along the transverse axis toward the outlet to an outlet width.

2. A method for suppressing the generation of iron-containing vapor during filling or emptying of a container for an iron-containing metal melt with the aid of $CO_2$ snow characterized in that a $CO_2$ snow jet is applied by means of a nozzle dispersing in a substantially planar manner onto a surface of an iron-containing stream which is poured into or out of the container, wherein the nozzle is positioned at a distance to the container of at least 1 meter with a moveable, mechanical guide arm.

3. The method of claim 2, wherein the moveable, mechanical guide arm is a robotic arm.

4. The method of claim 1, wherein the nozzle is positioned at a distance to the container of at least 3 meters with a moveable, mechanical guide arm.

5. The method of claim 4, wherein the moveable, mechanical guide arm is a robotic arm.

6. The method of claim 1, wherein the temperature is detected at the surface of, or in the, iron-containing stream and whereby a quantity of $CO_2$ snow that is applied onto the iron-containing stream is determined as a function of the detected temperature.

7. The method of claim 1, wherein the iron-containing stream has a width and the $CO_2$ snow jet covers the width completely.

8. The method of claim 1, wherein the $CO_2$ snow jet is applied onto the iron-containing stream at a rate of less than 500 kilograms $CO_2$ per minute.

9. The method of claim 1, wherein the iron-containing metal melt is selected from the group consisting of pig iron melts, gray cast iron melts, and steel melts.

10. The method of claim 1, wherein the $CO_2$ snow jet is applied onto the iron-containing stream at a rate of less than 200 kilograms $CO_2$ per minute.

11. The method of claim 10, wherein the nozzle comprises an intake for $CO_2$ which tapers as far as a region of the inlet of the nozzle.

12. Installation for carrying out a method of for suppressing the generation of iron-containing vapor during filling or emptying of a container for an iron-containing metal melt with the aid of $CO_2$ snow in which a $CO_2$ snow jet is applied by means of a nozzle dispersing the $CO_2$ jet in a substantially planar manner onto a surface of an iron-containing stream which is poured into or out of the container, said method comprising a container for an iron-containing metal melt, a control unit, a moveable, mechanical guide arm, and a nozzle mounted to the arm and spaced apart from the container for producing a substantially planar $CO_2$ snow jet or suppressing the generation of iron-containing vapor during the filling or emptying of a container for an iron-containing metal melt, wherein:

the nozzle has an inlet and an outlet which are spaced apart by a distance along an outlet axis;

the outlet axis is perpendicular to a vertical axis and to a transverse axis;

the nozzle tapers along the vertical axis toward the outlet to an outlet height;

the nozzle widens along the transverse axis toward the outlet to an outlet width; and a controller operatively associated with the nozzle that is adapted and configured for positioning the nozzle with the arm in a pouring zone adjacent the container and for controlling an amount of $CO_2$ snow applied to a surface of the iron-containing metal melt.

13. The installation of claim 12, further comprising a temperature detector adapted and configured to measure an ambient temperature of, or extending into, a stream of the metal melt being poured into or out of the container.

14. The installation of claim 13, wherein a quantity of the $CO_2$ snow to be applied to the surface of the metal-melt is directly controlled by the controller using the temperature detected by the temperature detector.

15. The installation of claim 13, wherein the temperature detector is a heat-resistant image generator provided to the arm.

16. The installation of claim 15, wherein the heat-resistant image generator is a thermal imaging camera adapted and configured to allow an operator to determine a quantify of the $CO_2$ snow to be applied to the surface of the iron-containing melt.

17. The installation of claim 12, wherein the container is selected from the group comprising metal converters, blast furnaces and transport vessels.

* * * * *